US007395684B2

(12) United States Patent
Ozturk

(10) Patent No.: US 7,395,684 B2
(45) Date of Patent: Jul. 8, 2008

(54) DRUM

(76) Inventor: Umud Esat Ozturk, Arcelik A.S., E5 Ankara Asfalti Uzeri, Tuzla, Istanbul (TR)

( * ) Notice: Subject to any disclaimer, the term of this patent is extended or adjusted under 35 U.S.C. 154(b) by 245 days.

(21) Appl. No.: 10/514,873

(22) PCT Filed: May 16, 2003

(86) PCT No.: PCT/TR03/00042

§ 371 (c)(1),
(2), (4) Date: Nov. 15, 2004

(87) PCT Pub. No.: WO03/097918

PCT Pub. Date: Nov. 27, 2003

(65) Prior Publication Data

US 2005/0155392 A1 Jul. 21, 2005

(30) Foreign Application Priority Data

May 17, 2002 (TR) ..... A 2002 01345

(51) Int. Cl.
*D06F 37/40* (2006.01)

(52) U.S. Cl. ..... 68/142; 68/139

(58) Field of Classification Search ..... 68/139, 68/140, 142

See application file for complete search history.

(56) References Cited

U.S. PATENT DOCUMENTS 2,480,929 A * 9/1949 Hyman ..... 34/108
2,758,461 A * 8/1956 Tann ..... 68/19.1
3,145,551 A * 8/1964 Ziegler ..... 68/4
3,249,230 A * 5/1966 Clement ..... 210/261
3,398,458 A * 8/1968 Yves et al. ..... 34/499
3,643,341 A * 2/1972 Magin ..... 34/444
3,682,094 A * 8/1972 Greis ..... 101/375
4,026,208 A * 5/1977 Horne et al. ..... 101/116
5,371,956 A 12/1994 St. Louis
5,495,681 A * 3/1996 Paradis ..... 34/602
5,771,718 A * 6/1998 Ide et al. ..... 68/142
6,343,492 B1 * 2/2002 Seagar et al. ..... 68/142
6,435,366 B1 * 8/2002 Johnson et al. ..... 220/62.22
6,935,143 B2 * 8/2005 Nitsche ..... 68/142

FOREIGN PATENT DOCUMENTS

BE 1012786 * 3/2001
DE 12 07 328 B 12/1965
GB 1161212 * 8/1966
JP 3-32700 * 2/1991
JP 8-252392 * 10/1996

* cited by examiner

*Primary Examiner*—Frankie L Stinson
(74) *Attorney, Agent, or Firm*—Venable, Campillo, Logan & Meaney PC

(57) ABSTRACT

This invention is related with a drum (1) in washing/drying machines, preferably in front loading in washing machines, rotating with a motor around its central axis inside a tub, manufactured of non-metal a material such as made of plastics, comprising one or more plates (3) manufactured separate from that drum (1), to cover the manufacturing faults such as flash at the edges of drum perforations (2) so as to prevent harm to laundries.

6 Claims, 4 Drawing Sheets

DRUM

The present invention is related to a drum used in washing and/or drying machines, preferably in front-loading washing machines.

In the state of the art, washing machines, preferably laundry machines comprise a fixed tub and a drum preferably made of plastics rotating inside such a tub. While washing, perforations are to be provided on the drum for the discharge of fluids revolving inside the drum. However, during the production, flash formed at the inlet of such perforations on the inner wall of the drum harms the laundries to be washed/dried.

U.S. Pat. No. 5,167,898 describes a mold group ensuring production of a plastic tub having perforations in the form of tear drops to prevent the harm to the washed laundries by potential flash.

European Patent EP0595040 describes a tub having perforations formed by cutting from outside projections extending from inner side to outer side to prevent potential flash to harm the laundries to be washed.

The object of this invention, is to achieve drum preventing the flash to harm the laundries to be washed/dried during its production without decreasing washing/drying performance.

Drum realized in order to attain the above-mentioned aims and objects of the invention is illustrated in the attached drawings, wherein:

FIG. 1*a* is a three-dimensional top view of a plate.

FIG. 1*b* is a three-dimensional bottom view of a plate.

FIG. 2*a* is a perspective top view of a plate comprising a rib angular with respect to its sides.

FIG. 2*b* is a perspective bottom view of a plate comprising an angular rib with respect to its sides FIG. 3 is a three-dimensional front view of a drum mounted on a plate comprising an angular rib with respect to its sides.

Figure 1A:
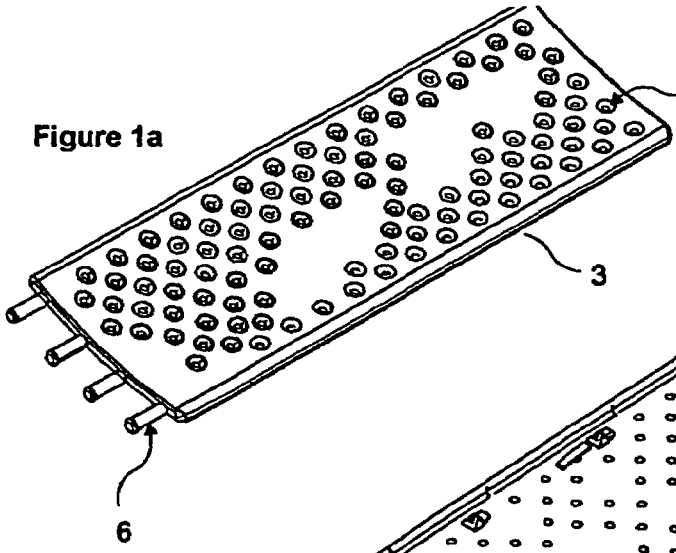
Figure 1B:
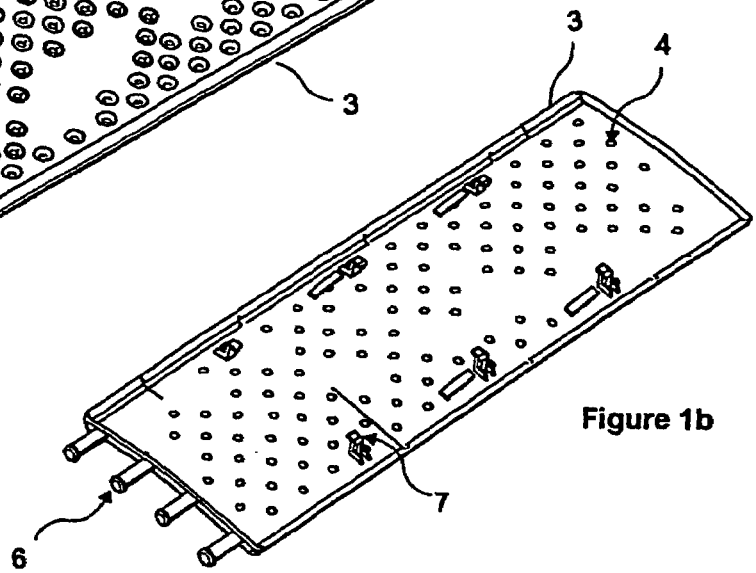
Figure 2A:
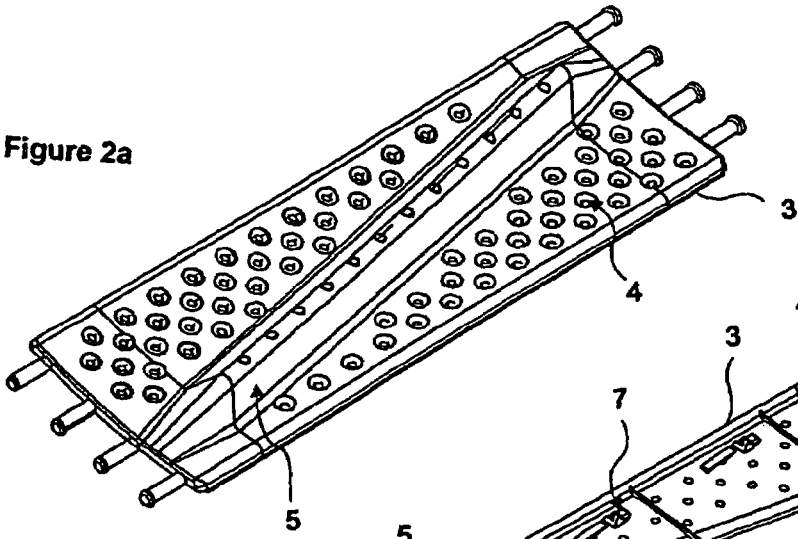
Figure 2B:
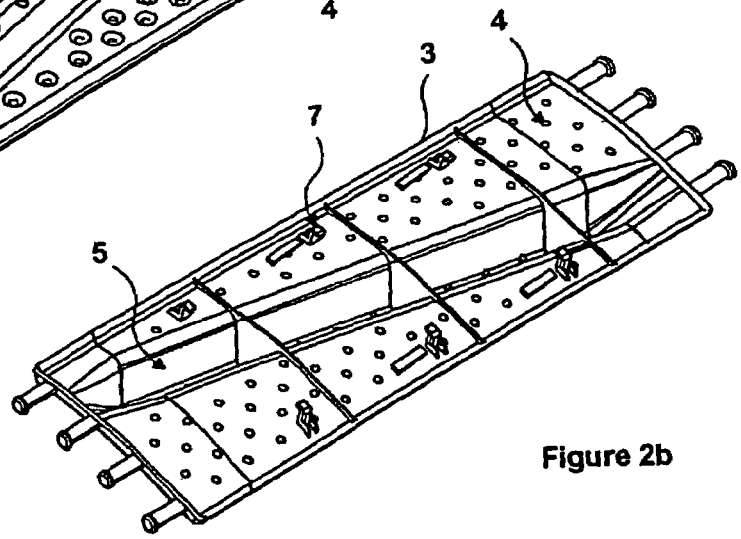
Figure 3:
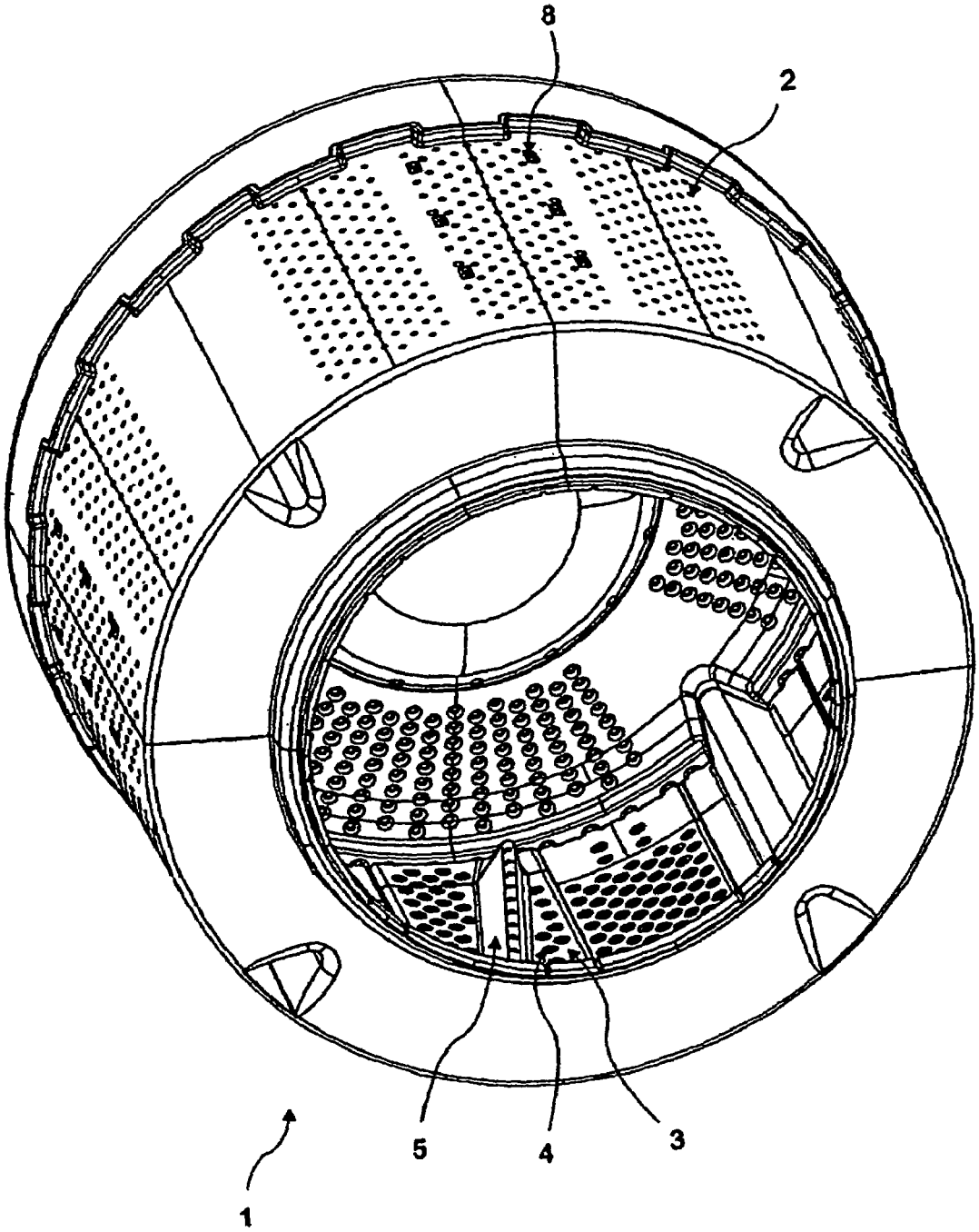
Figure 4:
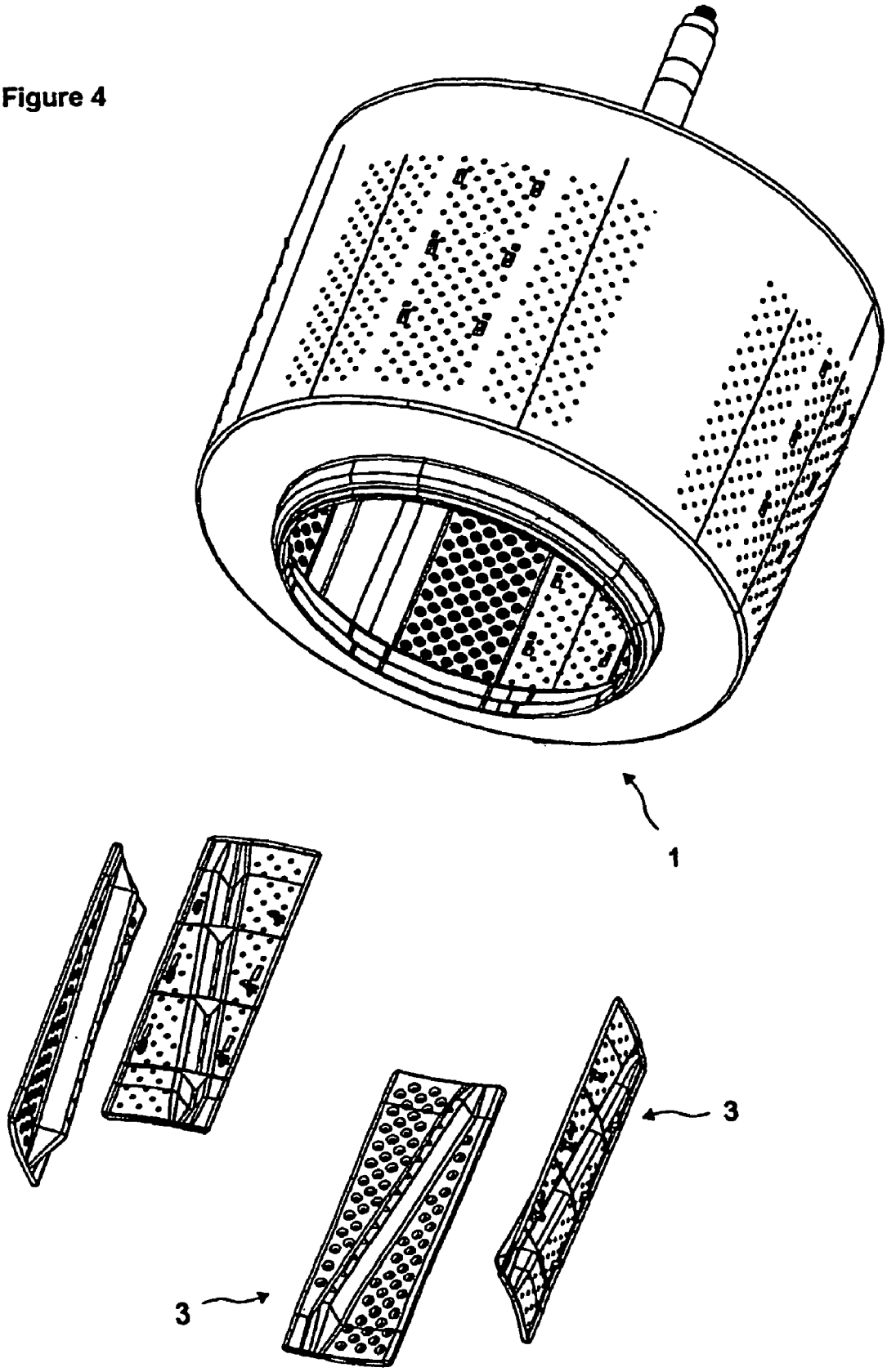
FIG. 4 is a three-dimensional exploded front view of a plate comprising a rib angular with respect to its sides and a drum on which more than one plates are mounted rib.
Figure 5:
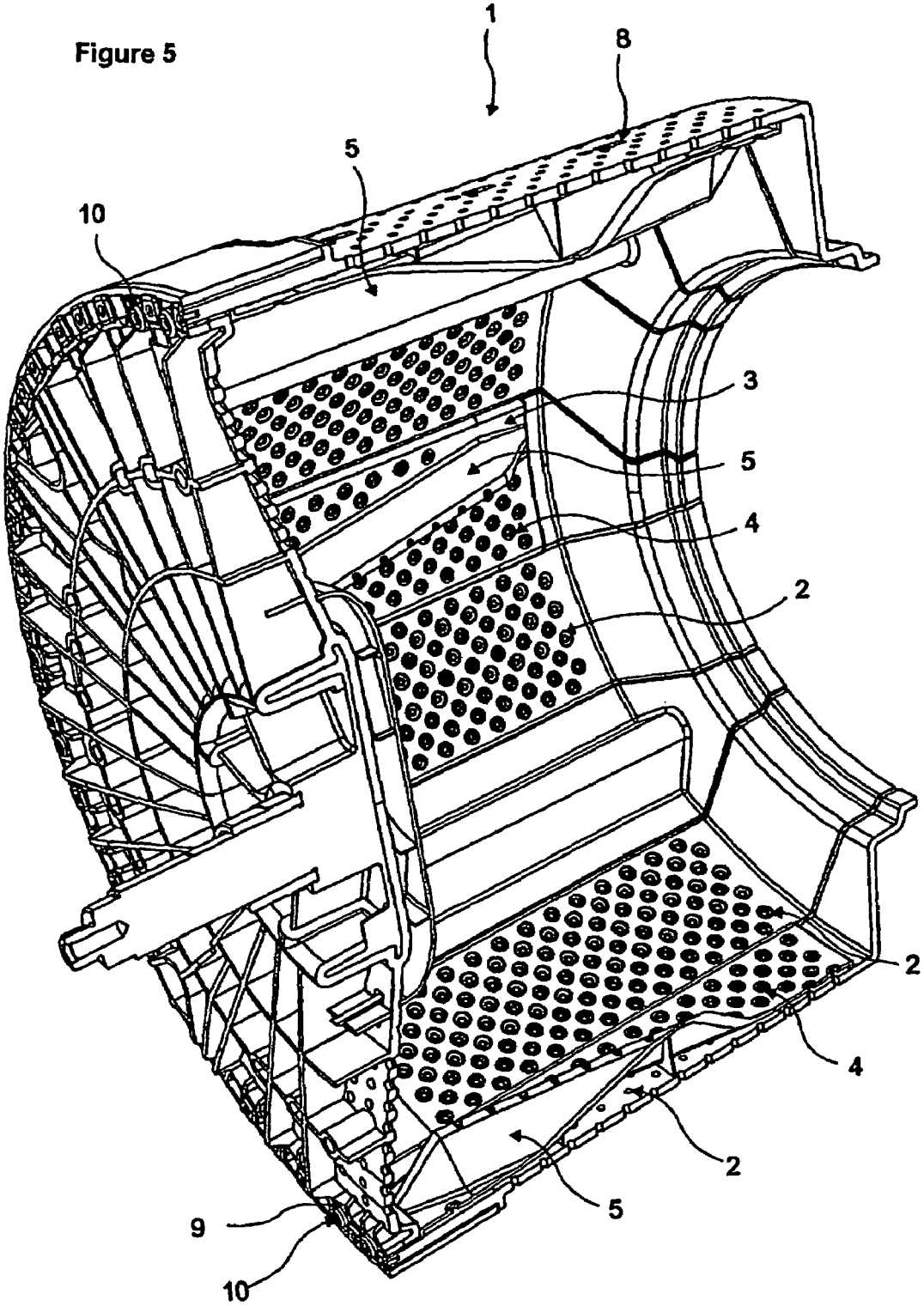
FIG. 5 is a perspective rear view of a drum cut into two at the center.

Parts shown in the figures have been numbered as follows.

1—Drum
2—Drum perforation
3—Plate
4—Plate perforation
5—Rib
6—Fastening projection
7—Plate claw
8—Claw recess
9—Projection hole Washing/drying machines, preferably in front-loading ones, comprise a drum (1) made of a non-metallic material, for instance made of plastics, which is rotated around its central axis inside a tub by means of a motor.

Drum (1) comprises more than one perforations (2) preferably of circular form ensuring the easy passage of fluids and gases which such a drum contains in the course of washing or drying operation and more than one plates (3) produced separate from drum to cover the flash that may be formed at the edges of a drum perforation (2) as a result of manufacturing faults to prevent laundries to be washed/dried from being harmed by such flash.

Plate (3) comprises, preferably on its surface below, one or more plate claws (7), which ensure fastening to the drum (1) and one or more fastening projections (6), which ensure fixing to the drum (1).

Drum (1) comprises a claw recess (8) corresponding to the plate claw, which ensures fastening of the plate claw (7) and a projection hole (9) corresponding to the such fastening hole (9).

Plate (3) comprises one or more plate perforations (4), to ensure the passage of fluids and gases, in the drum.

In preferred embodiment, a plate (3) is located between each rib couples positioned parallel to the central axis of the main body (2).

In another embodiment of the invention, the plate (3) comprises one or more ribs to enhance performance of the washing/drying machine. In a preferred embodiment, in order to eliminate unbalanced load distribution without preventing the circulation of the washing fluid and to ensure cost production, ribs are produced as hollow to have more than one plate perforations (4) on them to prevent the laundries to be harmed while washing and are located angular with respect to their sides. In another embodiment, ribs (5) are positioned in parallel to the sidewalls of the plates. In another embodiment, fins have curved surfaces.

While plates (3) are mounted onto the drum (2), plate claws (7) in the form of a hook on the plate (3) are mounted into claw recess (8) on drum (1) and are pushed towards the rear part in the direction of fastening. After plates (3) are mounted, fastening projections (6) on drum (1) and plate (3) are located inside the projection housings situated at rear side. After plate claws (7) are fastened to the projection hole (9) by applying force, fastening projections (6) on drum (1) and plate (5) are heated to form rivet head as much as in number of fastening projections of width to prevent release from their holes. Thus, fixing is provided on more than one spots of the drum (1) without using any other additional piece.

In another embodiments of the invention, mounting of the drum (1) and plate (3) to each other is provided by using fastening means such as rivets, screws or fastening methods such as friction welding, hot point welding or, laser welding.

In another embodiment, by means of the plates (3) of this invention, after perforations are formed in the outer wall towards inner wall of the cylindrical drum without any forms, projections or perforations, the inner part is covered with plates (3) having preferably plate perforations (4) and ribs (5) located side by side. In this way, costs of drum mold and production are reduced.

The invention claimed is:

1. A drum (1) made of a non-metallic material and having at least one manufacturing fault, to be used in washing/drying machines comprising; the drum having at least two drum holes (2) that facilitate the passage of gases and fluids during washing and/or drying operations, and at least one plate (3) that covers the at least one manufacturing fault, wherein the at least one plate (3) further comprises at least one plate bores (4) to ensure passage of fluids and gases, at least one plate claw (7) to be fastened to the drum (1) and at least one fastening projections (6), for fixing and further comprising a claw recess (8) corresponding to the plate claw (7) for fastening of the plate claw (7).

2. The drum (1) as defined in claims 1 further comprising a projection hole (9) corresponding to the fastening projection (6).

3. The drum (1) as defined in claim 2, wherein the at least one plate (3) further comprises at least one rib to enhance the performance of the washing/drying machine.

4. The drum (1) as defined in claim 3 wherein the at least one plate (3) includes sides and wherein the at least one rib is located angularly with respect to the sides.

5. The drum (1) as defined in claim 3 wherein the at least one a plate (3) includes sides and wherein the at least one rib is located in parallel with the sides.

6. The drum (1) as defined in claims 3, 4 and 5 wherein the at least one rib comprises curved surfaces.

* * * * *